US008126143B2

(12) United States Patent
Daniel et al.

(10) Patent No.: US 8,126,143 B2
(45) Date of Patent: Feb. 28, 2012

(54) APPARATUS AND METHOD FOR IMPROVING IN-GAME COMMUNICATIONS DURING A GAME

(75) Inventors: Isaac S. Daniel, Miami, FL (US); Michael Stibila, Lake Mary, FL (US)

(73) Assignee: ID Coach, LLC, Miramar, FL (US)

( * ) Notice: Subject to any disclaimer, the term of this patent is extended or adjusted under 35 U.S.C. 154(b) by 762 days.

(21) Appl. No.: 12/286,476

(22) Filed: Sep. 30, 2008

(65) Prior Publication Data

US 2010/0080388 A1 Apr. 1, 2010

(51) Int. Cl.
*H04N 7/167* (2011.01)

(52) U.S. Cl. ..... 380/239; 380/270; 380/251; 380/255

(58) Field of Classification Search ..... 380/239, 380/270, 251, 255
See application file for complete search history.

(56) References Cited

U.S. PATENT DOCUMENTS

| | | | | |
|---|---|---|---|---|
| 5,646,589 | A | 7/1997 | Murray et al. | |
| 7,171,553 | B2 * | 1/2007 | Rix et al. | 713/155 |
| 7,466,824 | B2 * | 12/2008 | Dobranski et al. | 380/260 |
| 7,702,101 | B2 * | 4/2010 | Malcolm et al. | 380/37 |
| 2002/0065097 | A1 * | 5/2002 | Brockenbrough et al. | 455/552 |
| 2002/0132211 | A1 | 9/2002 | August | |
| 2006/0025214 | A1 | 2/2006 | Smith | |
| 2007/0143382 | A1 | 6/2007 | Luster | |
| 2009/0022315 | A1 * | 1/2009 | Leung | 380/255 |
| 2010/0161984 | A1 * | 6/2010 | Pauker et al. | 713/168 |

FOREIGN PATENT DOCUMENTS

WO WO 2008/032315 A 3/2008

* cited by examiner

*Primary Examiner* — Krisna Lim
(74) *Attorney, Agent, or Firm* — Carol N. Green, Esq.

(57) ABSTRACT

The present invention is directed to an apparatus for improving communications between players and coaches during a sporting event, more specifically allowing players to dynamically receive real-time communications from their coaches concerning intended game plays to be effected on the field or court. Said game apparatus comprises of a transparent, protective top cover having the same contour as a middle portion, wherein said middle portion is provided with a display element, and wherein said top cover, middle portion and the display element are all enclosed by a rear cover forming a housing for a receiving means for receiving an encrypted signal of an intended game play from a portable remote terminal, and wherein said top cover, middle portion, display element and housing are positioned on an upper portion of an elasticized band, which has an extended flap, wherein said extended flap includes a closing means used to secure the game apparatus and to conceal the display element from public view.

19 Claims, 6 Drawing Sheets

APPARATUS AND METHOD FOR IMPROVING IN-GAME COMMUNICATIONS DURING A GAME

FIELD OF THE INVENTION

The present invention is directed to an apparatus and method for improving in-game communications, more specifically allowing players to dynamically receive communications from their coaches and/or other players concerning intended game plays to be effected on the field or court.

BACKGROUND OF THE INVENTION

Some sports allow coaches and/or individual players to call certain plays, i.e. game strategies, during the game, e.g. basketball, baseball, soccer, volleyball and football. In football, for example, the players are each required to learn all the "plays" in a playbook so that at game time, a coach can selectively call certain plays with minimal instructions to be executed on the field. However, these games have not been able to capitalize on technological advancements in the communications field as the method of communicating the plays still relies heavily on (a) oral communications in a huddle; (b) running the plays over speakers; (c) hand signals; or (d) a carefully scripted playlist on an armband, wristband or waistband.

The problem with the foregoing methods of communications is that they each have their limitations in providing efficient and secure transmissions. For example, a coach's instructions in a huddle can be overheard and even broadcasted live to the public at large when a game is being televised. In football, calling the plays via speakers are generally not known for their reliability as on occasion, the transmission is garbled, interrupted, or the external noise level on the field is so high that the recipient cannot hear the play. As for hand signals that are transmitted either from the sidelines, on the court or on the field, both the hand signals and the resulting plays are heavily watched by an opposing team to anticipate and counter the play. This is especially true if a coach repeatedly uses the same hand signals to run certain plays. In that event, the opposing team will counter the play by calling their own plays, run interferences and/or intercept the ball.

The problem is exacerbated when a player confuses the hand signals and compromises the play by executing something other than the intended game play. For example, a football coach may signal the quarterback from the sidelines to execute "WR 64, i.e. Wide Right 64" requiring the wide receiver to run wide and pass on the right. If the quarterback misinterprets the hand signals and instead runs narrow to the left, he may be exposed for interception, a tackle, and/or side out.

Players and coaches alike are very aware of the foregoing limitations and some players, e.g. football players, have resorted to wearing an extra wide wristband or waistband made of stretchable material with a Velcro® strap that unfolds to reveal a panel where the game plays are committed in writing for quick review. Except, in the heat of the game the margin for error is still high as the player must unfold the wristband or waistband and review several plays before identifying the intended game play, all within a matter of seconds. Thus, there is a need for an apparatus and method permitting secure transmissions of play instructions in realtime in a format that may be readily received, easily interpreted and universally understood by the players.

There is also need for creating a level playing field in sports, adding interest and intrigue to the games as neither team is made privy to the private communications of game plays between players and/or their coaches during the game.

This invention satisfies these long felt needs and solves the foregoing problems that the prior art has been unable to solve in a new and novel manner.

SUMMARY OF THE INVENTION

The present invention relates generally to a game apparatus and method for improving in-game communications for a sporting event or game having a transparent, protective top cover having a smooth contour with no sharp edges that is the same contour as a middle portion with a display element, where said top cover, middle portion and the display element are enclosed by a rear cover forming a housing for the means for receiving an encrypted signal of an intended game play from a portable remote terminal, where the top cover, middle portion with the display element and housing are all positioned on an upper portion of an elasticized band, which has an extended flap provided with closing means used to secure the game apparatus to a selected portion of a player's body, e.g. the wrist, upper arms, knees or a belt, and to conceal the display element from public view. The closing means may comprise of cooperating closing elements including a plurality of miniature monofilament hook elements cooperating with a plurality of miniature monofilament loop elements for detachable engagement, more commonly known as Velcro®, which is well known and used in the arts for detachably securing various fabrics and materials.

The game apparatus may be worn independently as a wristband, ankle band, neckband, armband, waistband, knee band, thigh band, with a belt or in any other form on the player's body that is readily available for easy access and review. In alternate embodiments of the invention, the game apparatus is seamingly connected along a single edge with another personal article, e.g. sport's glove.

The game apparatus further includes a circuit board, battery, microprocessor, reject button, activation switch, alarm notification means, antennae and wiring for the transmission and receipt of text messages and/or visual displays. The circuit comprises of a circuit board having a microprocessor positioned thereon and electrically connected to the receiving means for receiving the encrypted signals of the intended game play from the transmitting means of a portable remote terminal ("PRT"). The game apparatus communicates with the PRT via its communication means, which employ short range wireless protocol. Said communication means may include but is not limited to Blue Tooth, Zigbee, 802.11 series, or any other short range wireless protocol that is well known and used in the arts and other future short range wireless protocol suitable for transmitting data over a short distance. The PRT may comprise of a cell phone, computer, laptop, PDA and/or other WLAN communication devices that are known and readily used in the arts to transmit and/or receive wireless communications.

Additionally, the circuit comprises of a circuit board having a microprocessor positioned thereon and electrically connected to the receiving means, wherein upon receipt of the encrypted signal, an alarm signal is generated by said alarm notification means of the circuit, thereby alerting a player of a receipt of the encrypted signal of the intended game play. The receiving means may comprise of a transceiver, e.g. a Zigbee transceiver with integrated radio and shared antennae, or direct conversion receivers; digital radio receivers; super heterodyne receivers; or any other receivers or transceivers that are well known and used in the arts. The alarm notification means may comprise of a vibration motor electrically connected to the circuit board capable of causing a vibration of the game apparatus, or may include Dual-tone multi-frequency ("DTMF") decoders also electrically connected to the circuit board and speaker capable of sounding an audio alarm; a single tone alert system sounding an alarm like a Sonalert; or the microprocessor electrically connected to the display element programmed to flash a light thereon on receipt of the encrypted signal of the intended game play. In this manner, the alarm notification means may cause a vibration of the game apparatus, sound an alarm or flash a display on the display element, thereby alerting the game player of the received encrypted signal.

The microprocessor decrypts the encrypted signal for the intended game play for displaying either a text message and/or a visual display on the display element. The display element may be a liquid crystal display ("LCD") or light emitting diode ("LED") type, plasma, touch screen or other types of displays that are well known and used in the arts. The activation switch may optionally be used to at least one of, activate and reactivate the displaying means to display the decrypted signal of the intended game play on the display element of the invention. The display element will display the intended game play either in text and/or visual format for a few seconds, e.g. 10 seconds, before ending the display. However, a player may reactivate the displaying means to review the intended game play after the initial display ceased. Additionally, the displaying means may optionally be activated by using the activation switch to display the decrypted signal of the intended game play on the display element of the invention.

The middle portion and the protective top cover of the invention may have any one of the following shapes: circular, oblong, or rectangular. Said protective top cover protects the middle portion and the display element and circuits positioned therein. As such, the protective top cover is formed from a semi-rigid material to prevent breakage, damage and injury to the player and in certain embodiments of the invention treated to have a magnifying effect. Additional protection is derived from an extended flap, which is provided with additional padding. The additional padding may comprises of foam, fabric, rubber or any other materials used in the arts suitable for providing like protection. The extended flap of the game apparatus is sturdy, resilient and able to absorb shock associated with at least one of the following: football tackle, kick, sliding into base, hit by a pitch, a bat, a batted ball, a clubbed ball and/or heavy body contact.

While the invention has been described in conjunction with football, it is understood that the game apparatus may be used for several other games or sporting events and may include but is not limited to: football, baseball, soccer, volleyball and/or basketball, or any other games which allows players to receive in-game communications.

A primary object of the present invention is to provide a game apparatus and method for improving in-game communications between players and/or coaches during a game that overcomes the limitations of the prior art.

A primary object of the present invention is to provide a game apparatus for providing speedy real-time in-game communications between players and/or coaches during a game that overcomes the limitations of the prior art.

Another object of the present invention is to provide a game apparatus which uses an alarm notification means to alerting a player of the receipt of transmissions of intended game plays.

Still yet another object of the present invention is to provide a game apparatus wherein the top cover is formed from a semi-rigid transparent material.

Still yet another object of the present invention is to provide a game apparatus which includes a circuit board, battery, microprocessor, activation switch, reject button and wiring.

Another object of the present invention is to provide a game apparatus wherein said circuit board, battery and microprocessor are positioned on the underside of the middle portion, which is enclosed within a rear cover forming a housing.

Yet another object of the present invention is to provide an apparatus and method for secure communications between players and/or coaches.

Additional objects of the present invention will appear as the description proceeds.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Further objectives and advantages of the present invention may be derived by referring to the detailed description and claims when considered in connection with the Figures, wherein like reference numbers refer to similar items throughout the Figures.

Figure 2:
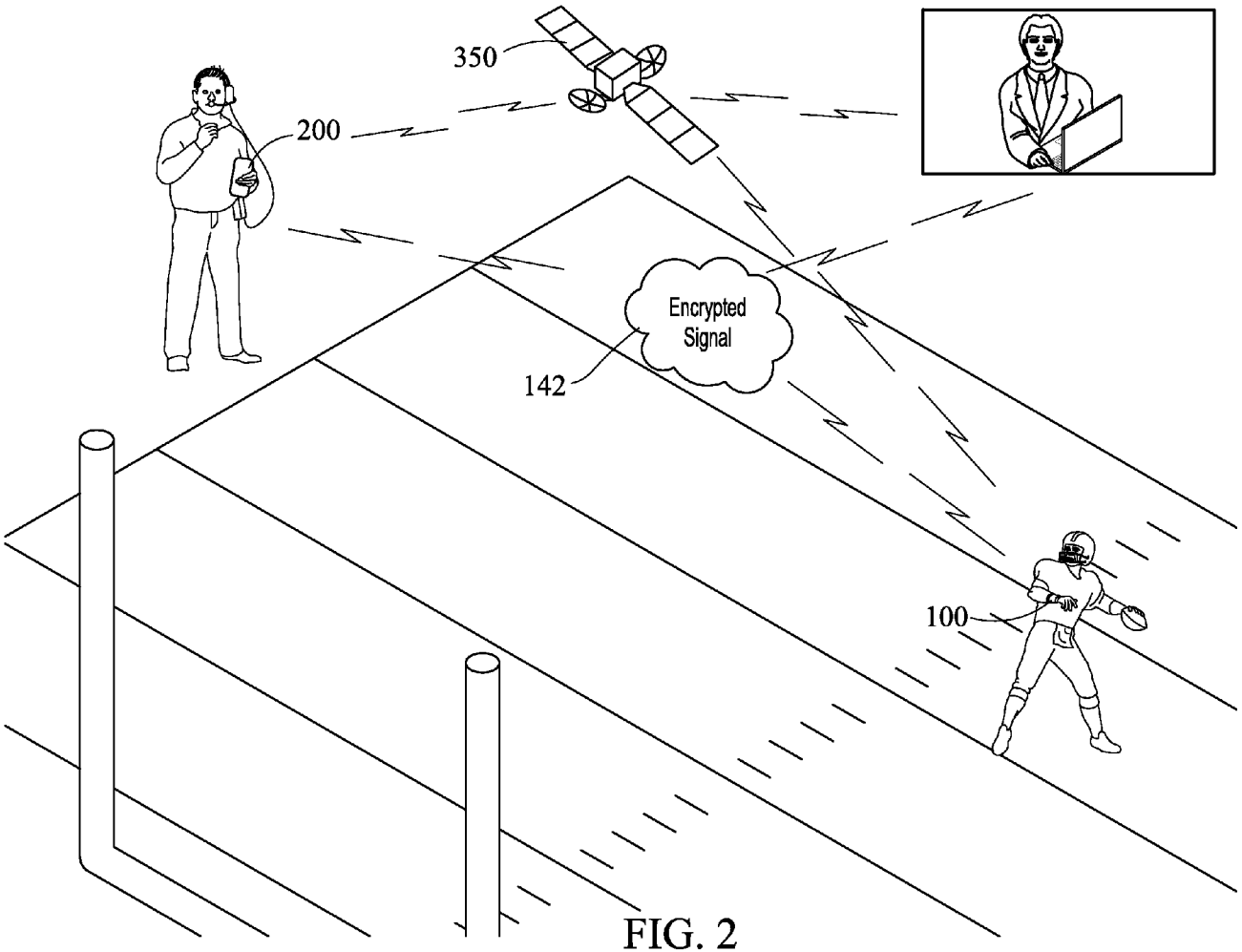

FIG. 2 an illustrative view of a system of the invention according to an embodiment of the invention.

Figure 3:
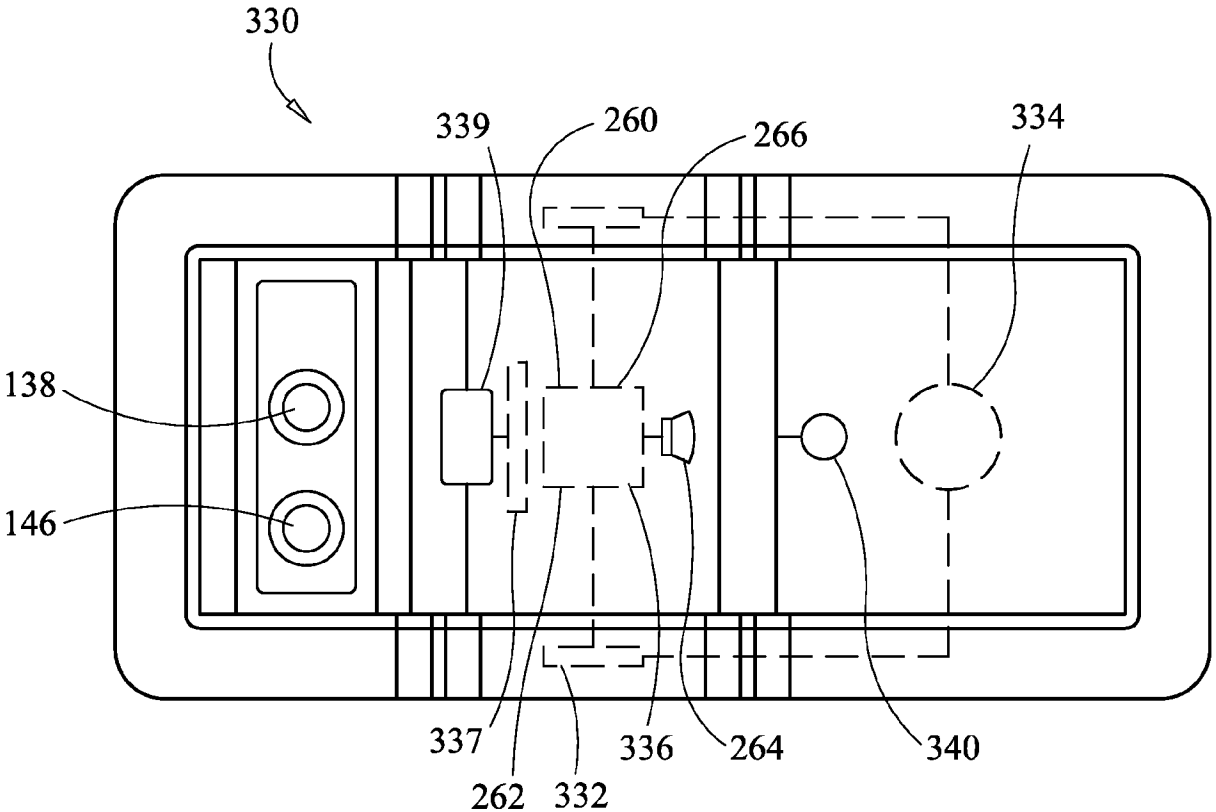

FIG. 3 is an illustrative view of a circuit assembly of the game apparatus according to an embodiment of the present invention.

Figure 4:
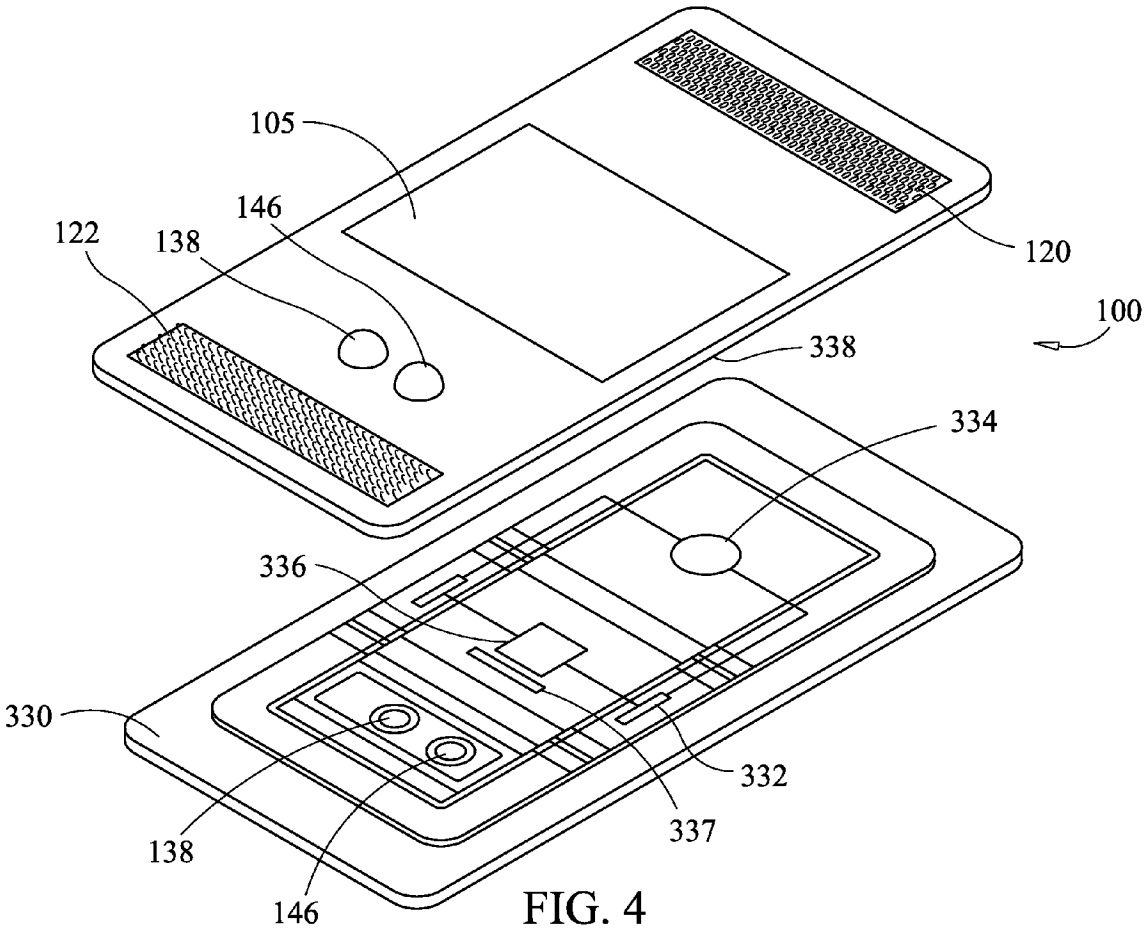

FIG. 4 is a partial cut-away view of the game apparatus according to an embodiment of the present invention.

Figure 5:
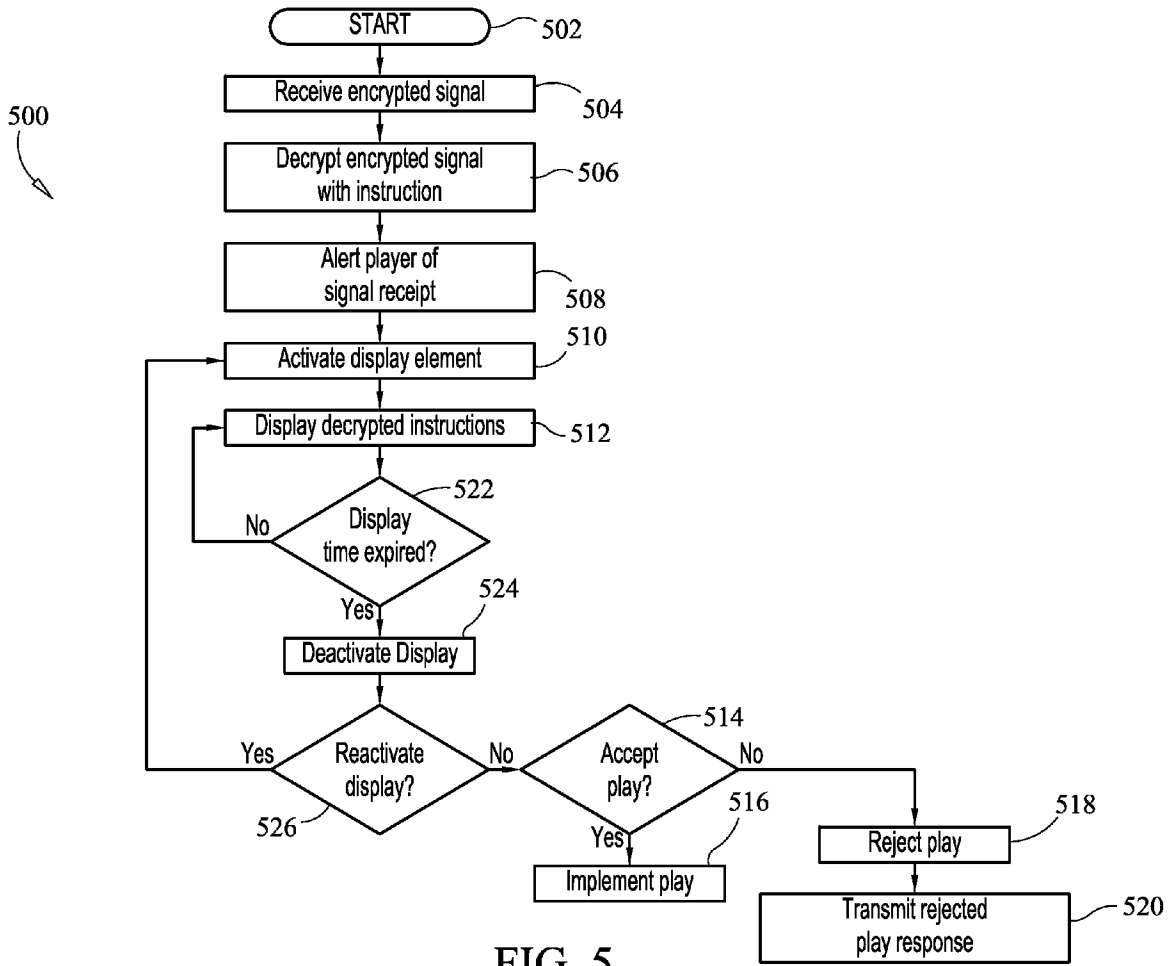

FIG. 5 is a flow chart illustrating a communication process according to an embodiment of the present invention.

DETAILED DESCRIPTION OF THE PREFERRED EMBODIMENT

The following discussion describes in detail an embodiment of the game apparatus (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1A through 5 illustrate the game apparatus of the present invention indicated generally by the numeral 100.

Figure 1A:
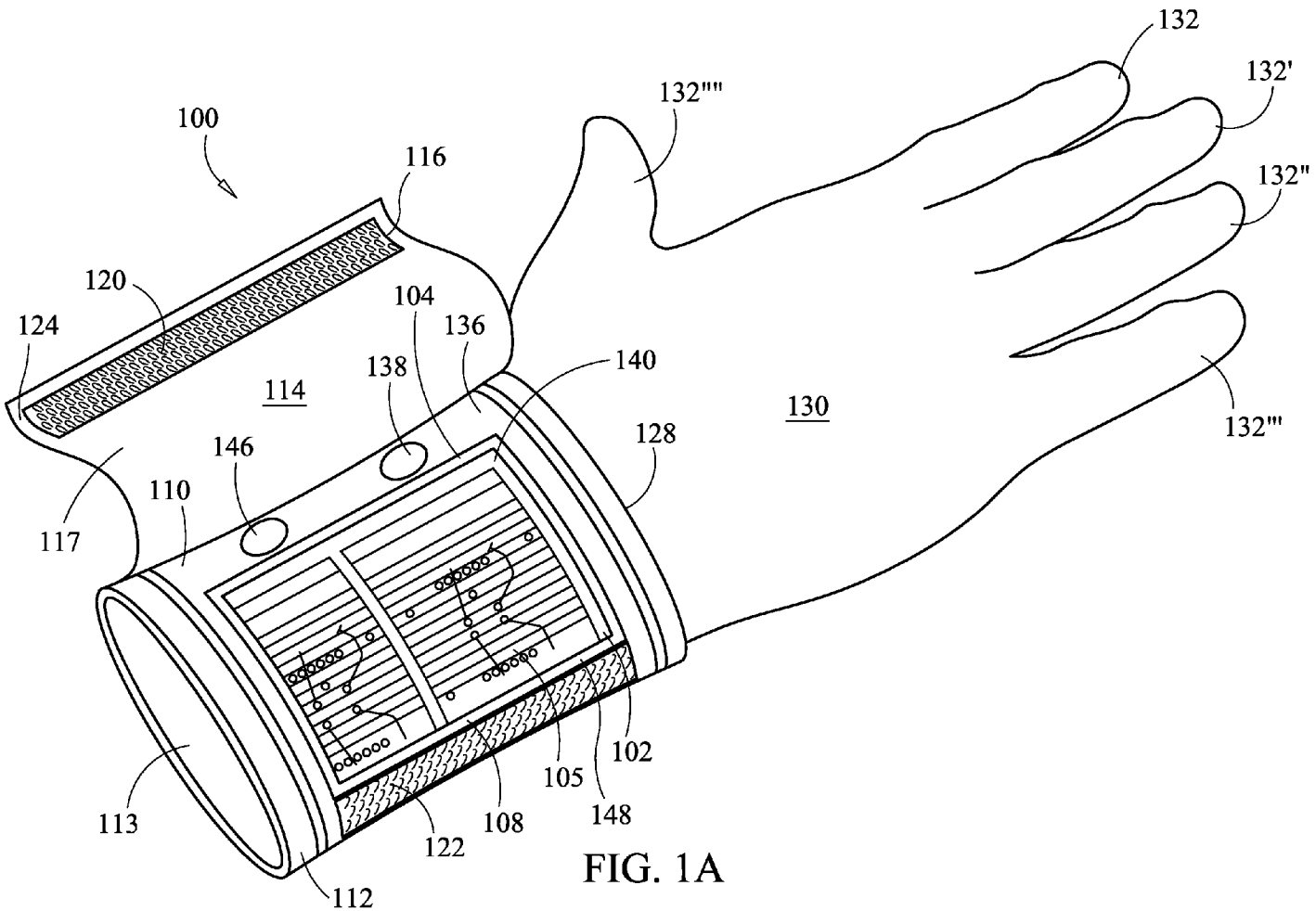
FIG. 1A is an illustrative view of the game apparatus according to an embodiment of the present invention.

FIG. 1A is an illustrative view of the game apparatus 100 according to an embodiment of the present invention. As shown in FIG. 1A, the game apparatus 100 comprises of a transparent protective cover 102 having a smooth contour with no sharp edges that is the same contour and shape as a middle portion 104 which is provided with a display element 105, which are enclosed by a rear cover 106 (not shown) forming a housing 108 for the receiving means 109 (not shown) of the game apparatus 100, all positioned on the upper portion 110 of an elasticized band 112.

The elasticized band 112 of the invention has an aperture 113 for receiving the player's body parts, e.g. wrists, therein and is sized to fit the player's body parts or a belt. The elasticized band 112 also includes an extended flap 114, which is provided with closing means 116 (not shown) on an underside 117 of the extended flap 114, used to secure the game apparatus 100 to a selected portion of the player's body, e.g. the wrist, upper arms, or knees, or to a belt. Said closing means 116 (not shown) may include cooperating closing elements including a plurality of miniature monofilament hook elements 120 cooperating with a plurality of miniature monofilament loop elements 122, or any other closing means 116 (not shown) suitable for detachably securing and unsecuring fabrics or materials. The monofilament hook elements 120 are affixed to an upper surface 124 of the underside 117 of the extended flap 114, while the monofilament loop elements 122 are affixed to the upper portion 110 of the elasticized band 112, or vice versa, to detachably secure the game apparatus 100 to the player's body parts or a belt.

Figure 1B:
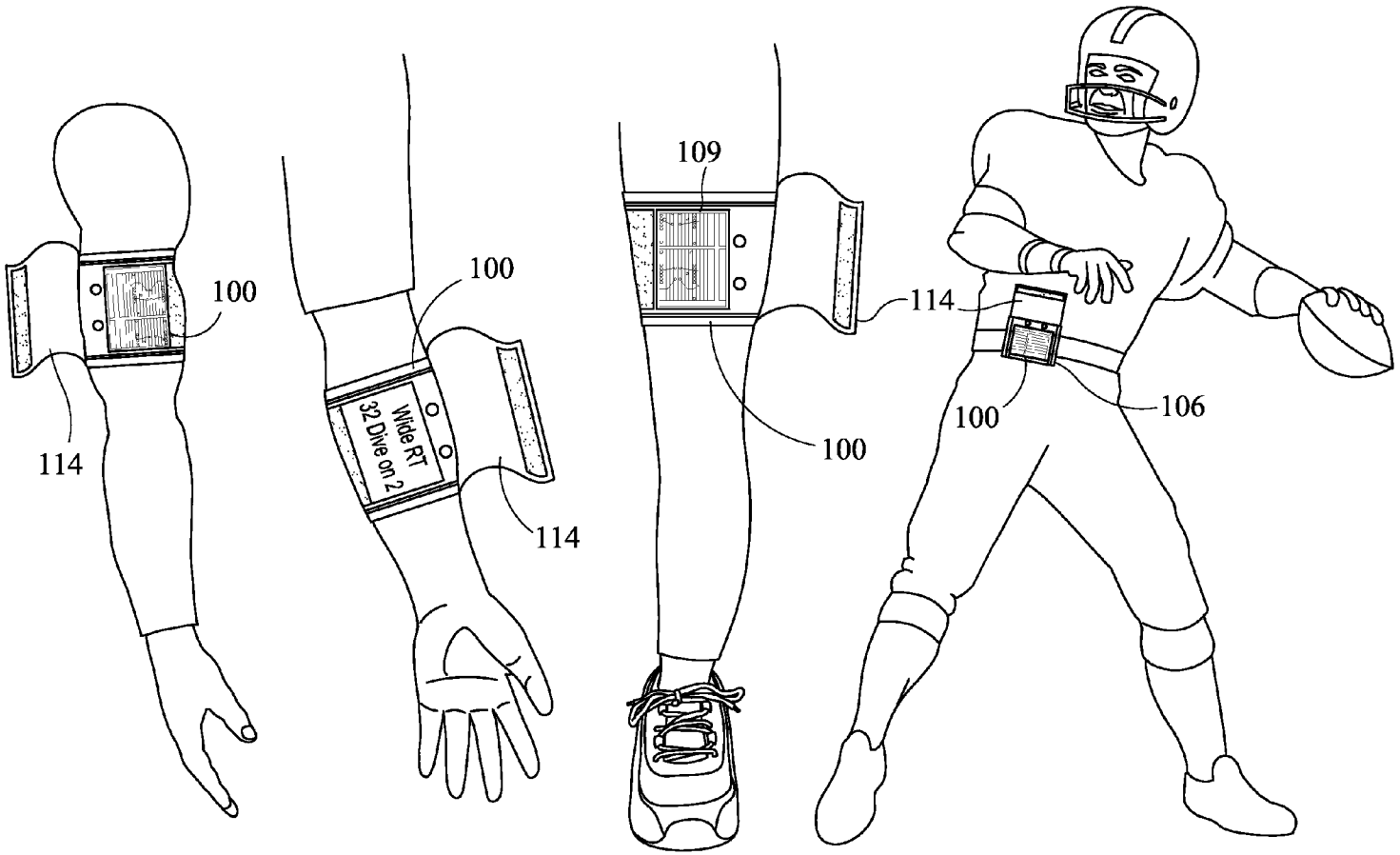
FIG. 1B shows an illustrative view of different embodiments of the present invention.

As seen in FIG. 1A, game apparatus 100 is seamingly connected along a single edge 128 of game apparatus 100 with the personal article 130, which in this case is a football glove. The personal article 130 may be seamingly connected by stitches, glue, or detachably secured with closing means 116 (not shown), e.g. Velcro®, to the game apparatus 100, or the personal article 130 may be in combination with apparatus game apparatus 100 forming a single, non-detachable unit. However, personal article 130 may include a belt or any other style glove suitable for the sport, e.g. baseball, golf. It is understood that if the personal article 100 is a belt, the belt may not be seamingly connected to the game apparatus 100 but may be secured via the closing means 116 (not shown) of the game apparatus 100. Here the football glove has fingers 132, 132', 132", 132''', 132'''' for receiving the player's fingers therein. As shown in FIG. 1B, game apparatus 100 of the invention may be worn as an armband, a wristband, a thigh band or with a detachable personal article 130, e.g. a belt.

Referring back to FIG. 1A, positioned on exterior surface 136 of game apparatus 100 is activation switch 138, which may be used to at least one of, activate and/or reactivate displaying means 140 (not shown) to display the decrypted intended game play for a few seconds on the display element 105 of the invention on receipt of a new intended game play. Said displaying means 140 (not shown) includes the microprocessor 336 electrically connected to the display element 105 programmed to perform any one of the following: flash a light on the display element 105 or display text and/or visual format of the decrypted intended game play. Also positioned on an exterior surface 136 of the game apparatus 100 is the reject button 146 which may be used to transmit an encrypted signal 142 of the rejected game play via the game apparatus' 100 transmitting means 148 (not shown) to the PRT 200.

It is understood that all players on the same team on or off the field and/or court may wear the game apparatus 100. As such, any player may transmit an encrypted signal 142 of the rejected game play via the game apparatus' 100 transmitting means 148 (not shown). Preferably the transmitting means 148 (not shown) and the receiving means 109 (not shown) include a combined wireless transceiver, e.g. a Zigbee transceiver with integrated radio and shared antennae. However, other wireless transceivers that are well known and used in the arts may be used to practice the invention. As shown in FIG. 1, both the activation switch 138 and the reject button 146 are positioned on the upper exterior surface 136 of the game apparatus 100. However, it is understood that they both could easily have been on the side or any other location on the exterior surface 136 of the game apparatus 100.

The middle portion 104 and the protective top cover 102 of the invention may have any one of the following shapes: circular, oblong, or rectangular. Said protective top cover 102 protects the middle portion 104, the display element 105 and circuits positioned therein. As such, the protective top cover 102 is formed from a semi-rigid material to prevent breakage, damage and injury to the player and in certain embodiments of the invention treated to have a magnifying effect. In alternate embodiments of the invention, the display element 105 is provided with lighting or backlighting such that it can be used at night without compromising the visibility of the display.

FIGS. 2 & 5 show an illustrative view of a system 205 according to an embodiment of the present invention and a communication process 500 according to an embodiment of the present invention. As the football game progresses a coach on the field, in the viewing box or anywhere else on the field or in the nearby vicinity may require for example, the quarterback to execute a particular intended game play. As such, a coach may select the intended game play from a PRT 200 that is provided with software to include a playlist in text, codes and/or visual format. Once an intended game play is selected, the PRT 200 transmits in realtime an encrypted signal 142 of the intended game play to the receiving means 109 (not shown) of the game apparatus 100 using for example WiHLoN™, Zigbee, Blue Tooth, 802.11 series, or any other short range wireless protocol that is well known and used in the arts. As mentioned supra, the receiving means 109 (not shown) may comprise of a transceiver, e.g. a Zigbee transceiver with integrated radio and shared antennae; direct conversion receivers; digital radio receivers; super heterodyne receivers; or any other receivers or transceivers that are well known and used in the arts.

Upon receipt of the encrypted signal in step 504, the microprocessor 336 of the game apparatus 100, decrypts the encrypted signal 142 in step 506 for the intended game play and sends an alarm signal 143 to the alarm notification means 214 (not shown) in step 508, thereby alerting the player of the receipt of a transmission of an intended game play, all executed within a matter of seconds. The alarm notification means 214 (not shown) may comprise of a vibration motor 260 (not shown) electrically connected to the circuit board 332 capable of causing a vibration of the game apparatus, or may include Dual-tone multi-frequency ("DTMF") decoders 262 (not shown) also electrically connected to the circuit board 332 and speaker 264 (not shown) capable of sounding an audio alarm; a single tone alert system 266 (not shown) sounding an alarm like a Sonalert; or the microprocessor 336 electrically connected to the display element 105 programmed to flash a light thereon on receipt of the encrypted signal 142 of the intended game play. In this manner, the alarm notification means 214 may cause for example a vibration of the game apparatus, sound an audio alarm or flash a light, thereby alerting the game player of the received encrypted signal 142.

If the extended flap 114 is in the closed position a player may undo the closing means 116 (not shown) of the extended flap 114 and activate the displaying means 140(not shown) by using the activation switch 138 in step 510 to display the decrypted intended game play on the display element 105 in step 512, which may display either a text message and/or a visual display. However, in alternate embodiments of the invention, the game apparatus 100 may not include an extended flap 114 or a player may choose to keep it in an open position. In either event, the game apparatus 100 may automatically display the decrypted intended game play without being activated by the activation switch 138.

The displaying means 140(not shown) may be programmed to activate the display element 105 to display the decrypted intended game play for a predetermined period, e.g. 10-20 seconds and will continue to verify if the display time has expired as in step 522. If the display time has not expired, the display element 105 will continue to display the decrypted intended game play instructions until it does by returning to steps 512-522. Once the display time has expired, the microprocessor 336 will deactivate the display element 105 as in step 524 and cease the display. However, the display element 105 may be reactivated to re-display the intended game play as in step 526, by depressing the activation switch 138, in which case the microprocessor 336 will return to steps 510-526. In this manner if a player forgets the intended game play he has an opportunity to review the intended game play after the display has ceased.

The player then decides in step 514 whether to reject or accept the decrypted intended game play. If the player chooses to reject the play, the player may communicate the rejection by using the reject button 146 in step 518 which transmits an encrypted signal 142 of the rejected play to the coach's PRT 200 in step 520. Otherwise, the player may accept the coach's instruction and then implement the intended game play/instructions in step 518. In this manner, the coach's instructions and the players' communications of rejected plays are transmitted in a secure environment that will not be intercepted, overheard, and/or anticipated by the opposing team or side.

FIG. 3 is an illustrative view of the circuit assembly 330 of the game apparatus 100 according to an embodiment of the present invention. The circuit 330 is comprised of a circuit board 332, having a power source 334 and microprocessor 336 positioned thereon. Conventional wires connect the circuit board 332 with the activation switch 138 and the reject button 146. Preferably, the circuit board 332 is formed from a polyimide film which is flexible yet can remain stable in a wide range of extreme temperatures, e.g. Kapton®. However, the circuit board 332 may be formed from silicon, fiberglass, Mylar, or other suitable materials that are well known and used in the arts. The circuit board 332 is small enough to be contained within the housing 108 of the middle portion 104 of the game apparatus 100. An antenna 337 is electrically connected to the microprocessor 336 on the circuit board 332 or alternatively imbedded within the microprocessor 336. Alternatively, the antenna 337 may be incorporated within a wiring harness 338 (not shown) or sewn into the fabric of the elasticized band 112.

The game apparatus 100 includes communication means 339 (not shown) for the receipt and transmissions of wireless communications through a wireless communications network 350 (not shown). Said communication means 339 (not shown) may include but is not limited to Blue Tooth, Zigbee, 802.11 series, or any other short range wireless protocol that is well known and used in the arts and other future short range wireless protocol suitable for transmitting and receiving data over a short distance. Upon receipt of an encrypted signal 142 for an intended game play, the microprocessor 336 of the game apparatus 100, decrypts the encrypted signal 142, sends an alarm signal 143 to the alarm notification means 340 (not shown) of the receipt of the incoming transmission, causing for example a vibration of the game apparatus 100, thereby alerting the player of the received intended game play. The player may activate the displaying means 140 by using the activation switch 138 to view the intended game play on the display element 105 which displays either a text message and/or a visual display for a predetermined period of time, e.g. 10 seconds.

FIG. 4 is a partial cut-away view of the game apparatus 100 having a circuit 330 contained therein. The circuit 330 is comprised of a circuit board 332, having a power source 334 and microprocessor 336 positioned thereon. Conventional wires connect the circuit board 332 with the activation switch 138 and the reject button 146. Preferably, the circuit board 332 is formed from a polyimide film which is flexible yet can remain stable in a wide range of extreme temperatures, e.g. Kapton®. However, the circuit board 332 may be formed from silicon, fiberglass, Mylar, or other suitable materials that are well known and used in the arts. The circuit board 332 is small enough to be contained within the housing 108 of the middle portion 104 of the game apparatus 100. An antenna 337 is electrically connected to the microprocessor 336 on the circuit board 332 or alternatively imbedded within the microprocessor 336. Alternatively, the antenna 337 may be incorporated within a wiring harness 338 (not shown) or sewn into the fabric of the elasticized band 112.

The game apparatus 100 includes communication means 339 (not shown) for the receipt and transmissions of wireless communications through a wireless communications network 350 (not shown). Upon receipt of an encrypted signal 142 for an intended game play, the microprocessor 336 of the game apparatus 100, decrypts the encrypted signal 142, sends an alarm signal 143 to the alarm notification means 340 (not shown) of the receipt of the incoming transmission, causing for example a vibration of the game apparatus 100, thereby alerting the player of the received intended game play. The player may activate the displaying means 140 by using the activation switch 138 to view the intended game play on the display element 105 which displays either a text message and/or a visual display for a predetermined period of time, e.g. 10 seconds.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An apparatus for improving communications during a sporting event comprising of:

(a) a transparent, protective top cover having the same contour as a middle portion, wherein said middle portion is provided with a display element, and wherein said top cover, middle portion and the display element are enclosed by a rear cover forming a housing for a receiving means for receiving an encrypted signal of an intended game play from a portable remote terminal, wherein said top cover, middle portion, display element and housing are positioned on an upper portion of an elasticized band, which has an extended flap, wherein said extended flap includes a closing means used to secure the game apparatus and to conceal the display element from public view;

(b) an electronic circuit, wherein said circuit comprises of a circuit board having a microprocessor positioned thereon and electrically connected to said receiving means, wherein said electronic circuit further comprises of an alarm notification means which generates an alarm signal upon receipt of said encrypted signal of the intended game play, thereby alerting a player of receipt of said encrypted signal; and (c) decrypting means for decrypting said encrypted signal that is electrically connected to an activation switch for activating the display means to display a decrypted signal of the intended game play on the display element of said middle portion.

2. The apparatus of claim 1, wherein the alarm notification means is capable of any one of the following: causing a vibration of said game apparatus, sounding an audio alarm and flashing a light on the display element.

3. The apparatus of claim 1, wherein the display element is any one of the following: a liquid crystal display and light emitting diode type.

4. The apparatus of claim 1, wherein the display element displays in any one of the following formats: text and visual.

5. The apparatus of claim 1, wherein the middle portion and the protective top cover have any one of the following shapes: circular, oblong, or rectangular.

6. The apparatus of claim 1, wherein the extended flap includes additional padding to protect the middle portion with the display element and the circuits positioned therein.

7. The apparatus of claim 1, wherein the extended flap is able to absorb shock associated with at least one of the following: football tackle, kick, sliding into base, hit by a pitch, a bat, a batted ball, a clubbed ball and/or heavy body contact.

8. The apparatus of claim 1, further comprising of an aperture for receiving the player's body parts.

9. The apparatus of claim 1, wherein the game apparatus may be worn independently as any one of the following: a wristband, ankle band, neckband, armband, waistband, knee band, thigh band or with a belt.

10. The apparatus of claim 1, wherein said game apparatus is used for at least one of the following games: football, baseball, volleyball, soccer and basketball.

11. The apparatus of claim 1, wherein said top cover is formed from a semi-rigid material for preventing breakage, damage and injury to the wearer.

12. The apparatus of claim 1, wherein said closing means comprises of a plurality of miniature filament hook elements on one of said surfaces and miniature filament loop elements on said opposing surface for cooperating with said hook elements.

13. An apparatus for improving communications during a sporting event comprising of:

(a) a personal article in combination with an apparatus which includes a transparent, protective top cover having the same contour as a middle portion, wherein said middle portion is provided with a display element, and wherein said top cover, middle portion and the display element are enclosed by a rear cover forming a housing for a receiving means for receiving an encrypted signal of an intended game play from a portable remote terminal, wherein said top cover, middle portion, display element and housing are positioned on an upper portion of an elasticized band, which has an extended flap, wherein said extended flap includes a closing means used to secure the game apparatus and to conceal the display element from public view;

(b) an electronic circuit, wherein said circuit comprises of a circuit board having a microprocessor positioned thereon and electrically connected to said receiving means, wherein said electronic circuit further comprises of an alarm notification means which generates an alarm signal upon receipt of said encrypted signal, thereby alerting a player of a receipt of said encrypted signal; and (c) decrypting means for decrypting said encrypted signal that is electrically connected to an activation switch for activating the display element to display a decrypted signal of the intended game play on the display element of said middle portion.

14. The apparatus of claim 13, wherein said personal article comprises of a glove.

15. The apparatus of claim 13, wherein said personal article is seamingly connected to the apparatus.

16. A process for improving communications with a player during a sporting event comprising:

(a) receiving an encrypted signal containing game play instructions, wherein said encrypted signal is received on a game apparatus worn by said player;

(b) decoding said encrypted signal;

(c) alerting said player of the receipt of the encrypted signal;

(d) activating a display element;

(e) displaying said decrypted game play instructions on said display element.

17. The process of claim 16 further comprising the step of transmitting a message signaling the player's rejection of said decrypted game play instructions to a portable remote terminal.

18. The process of claim 16, wherein the step of alerting the player is effected by an alarm.

19. The process of claim 16, further comprising the step of providing means to reject said play.

* * * * *